US009214119B2

(12) United States Patent
Yano et al.

(10) Patent No.: US 9,214,119 B2
(45) Date of Patent: Dec. 15, 2015

(54) DISPLAY, IMAGE PROCESSING UNIT, AND DISPLAY METHOD INVOLVING FRAME RATE CONVERSION AND BLUR REDUCTION

(71) Applicant: JOLED Inc., Tokyo (JP)

(72) Inventors: Tomoya Yano, Kanagawa (JP); Shoji Araki, Kanagawa (JP); Hidehisa Shimizu, Tokyo (JP); Munenori Ono, Kanagawa (JP); Fumihiko Fujishiro, Tokyo (JP)

(73) Assignee: JOLED Inc., Tokyo (JP)

( * ) Notice: Subject to any disclaimer, the term of this patent is extended or adjusted under 35 U.S.C. 154(b) by 266 days.

(21) Appl. No.: 13/893,065

(22) Filed: May 13, 2013

(65) Prior Publication Data

US 2013/0321487 A1 Dec. 5, 2013

(30) Foreign Application Priority Data

Jun. 4, 2012 (JP) ..... 2012-127015

(51) Int. Cl.

| | |
|---|---|
| ***G09G 3/30*** | (2006.01) |
| ***G09G 3/36*** | (2006.01) |
| ***G09G 3/20*** | (2006.01) |

(52) U.S. Cl.

CPC ..... *G09G 3/3611* (2013.01); *G09G 3/20* (2013.01); *G09G 3/30* (2013.01); *G09G 2320/0257* (2013.01); *G09G 2340/0435* (2013.01)

(58) Field of Classification Search

CPC ..... H04N 7/012; H04N 7/01; H04N 7/0102; H04N 7/0127; H04N 7/0135

See application file for complete search history.

(56) References Cited

U.S. PATENT DOCUMENTS

| | | | | |
|---|---|---|---|---|
| 5,111,297 | A * | 5/1992 | Tsuji et al. | 348/565 |
| 5,510,843 | A * | 4/1996 | Keene et al. | 348/446 |
| 5,898,414 | A * | 4/1999 | Awamoto et al. | 345/55 |
| 6,559,839 | B1 * | 5/2003 | Ueno et al. | 345/213 |
| RE40,074 | E * | 2/2008 | Butler et al. | 348/447 |
| 2001/0022612 | A1 * | 9/2001 | Higuchi et al. | 348/65 |
| 2007/0229705 | A1 * | 10/2007 | Chida et al. | 348/448 |
| 2010/0053429 | A1 | 3/2010 | Miyazaki et al. | |

FOREIGN PATENT DOCUMENTS

JP 2008-268436 A 11/2008

* cited by examiner

*Primary Examiner* — Victor Kostak

(74) *Attorney, Agent, or Firm* — Michael Best & Friedrich LLP

(57) ABSTRACT

A display includes: a display section; and a display driving section driving the display section based on a first image data set and a second image data set that alternate with each other. The display driving section drives the display section by performing a first scan with use of a first block as a driving unit in accordance with the first image data set and a second scan with use of a second block as a driving unit in accordance with the second image data set. The first block is composed of a plurality of consecutive pixel lines, and the second block is composed of a plurality of consecutive pixel lines and is different from the first block.

15 Claims, 16 Drawing Sheets

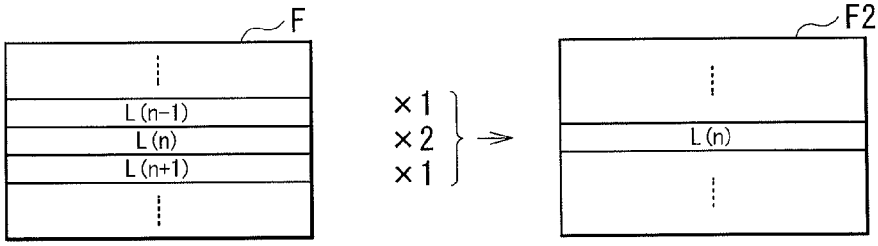
FIG. 3
FIG. 4A
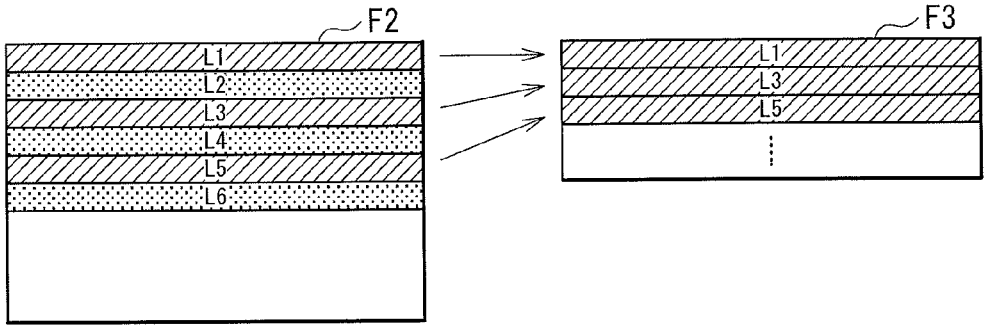
FIG. 4B
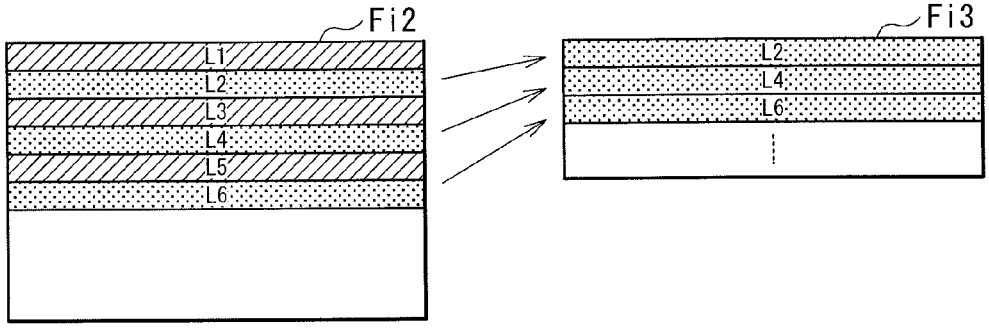

DISPLAY, IMAGE PROCESSING UNIT, AND DISPLAY METHOD INVOLVING FRAME RATE CONVERSION AND BLUR REDUCTION

BACKGROUND

The present disclosure relates to a display for displaying images, an image processing unit in use for such a display, and a display method.

In recent years, replacement of a CRT (Cathode Ray Tube) display with a liquid crystal display or an organic EL (Electro-Luminescence) display has been in progress. These displays are so-called hold-type display devices. More specifically, such displays continue to display the same image during a single frame period between intervals from a display cycle of one still image until the next display cycle of another still image. Accordingly, in watching a moving object that is displayed on such a display, a viewer attempts to view an image while following the moving object smoothly, which causes an image on retinas to move across the center of the retina during a single frame period. Consequently, in viewing moving images on such a display, this results in occurrence of so-called a hold-blur, which makes a viewer feel as if the image quality would deteriorate.

Several considerations have been given concerning a method to suppress this hold blurring. For example, Japanese Unexamined Patent Application Publication No. 2008-268436 discloses a liquid crystal display that drives a backlight in a blinking state and shortens a hold-display time of an image, thereby reducing a hold-blur. Further, for example, Japanese Unexamined Patent Application Publication No. 2010-56694 discloses a display that reduces a hold-blur by performing a frame rate conversion.

SUMMARY

Meanwhile, in a display, it is generally desired to enhance the image quality thereof. In concrete terms, it may be desired to achieve high-resolution images, or it may be desired to increase a frame rate from a viewpoint of response to moving images.

It is desirable to provide a display, an image processing unit, and a display method that allow the image quality to be enhanced.

According to an embodiment of the present disclosure, there is provided a display including: a display section; and a display driving section driving the display section based on a first image data set and a second image data set that alternate with each other. The display driving section drives the display section by performing a first scan with use of a first block as a driving unit in accordance with the first image data set and a second scan with use of a second block as a driving unit in accordance with the second image data set. The first block is composed of a plurality of consecutive pixel lines, and the second block is composed of a plurality of consecutive pixel lines and is different from the first block.

According to an embodiment of the present disclosure, there is provided an image processing unit including: a display driving section driving the display section by performing a first scan with use of a first block as a driving unit in accordance with a first image data set and a second scan with use of a second block as a driving unit in accordance with a second image data set. The first block is composed of a plurality of consecutive pixel lines, the second block is composed of a plurality of consecutive pixel lines and is different from the first block, and the first image data set and the second image data set alternate with each other.

According to an embodiment of the present disclosure, there is provided a display method including: preparing a first image data set and a second image data set alternating with each other; and driving the display section by performing a first scan with use of a first block as a driving unit in accordance with the first image data set and a second scan with use of a second block as a driving unit in accordance with the second image data set, the first block being composed of a plurality of consecutive pixel lines, and the second block being composed of a plurality of consecutive pixel lines and being different from the first block.

In the display, the image processing unit, and the display method according to the above-described respective embodiments of the present disclosure, a display is carried out based on the first image data set and the second image data set that alternate with one another. At the time of such a display operation, in the display section, the first scan for the first block as a driving unit is performed in accordance with the first image data set, while the second scan for the second block that is different from the first block as a driving unit is performed in accordance with the second image data set.

In the display, the image processing unit, and the display method according to the above-described respective embodiments of the present disclosure, the first scan is performed for the first block as a driving unit, while the second scan is performed for the second block that is different from the first block as a driving unit, which allows the image quality to be enhanced.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification. The drawings illustrate embodiments and, together with the specification, serve to explain the principles of the present technology.

FIG. 3 is a schematic diagram showing an operation example of a filter illustrated in FIG. 1.

FIGS. 4A and 4B are each a schematic diagram showing an operation example of an image separation section illustrated in FIG. 1.

Figure 1:
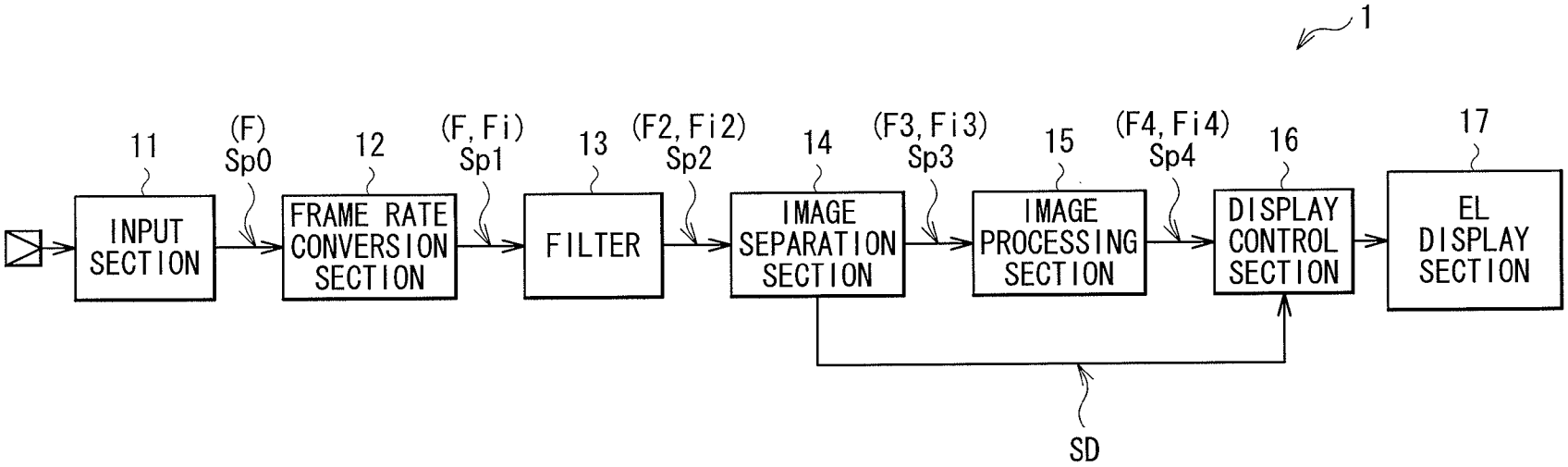
FIG. 1 is a block diagram showing a configuration example of a display according to a first embodiment of the present disclosure.
Figure 6:
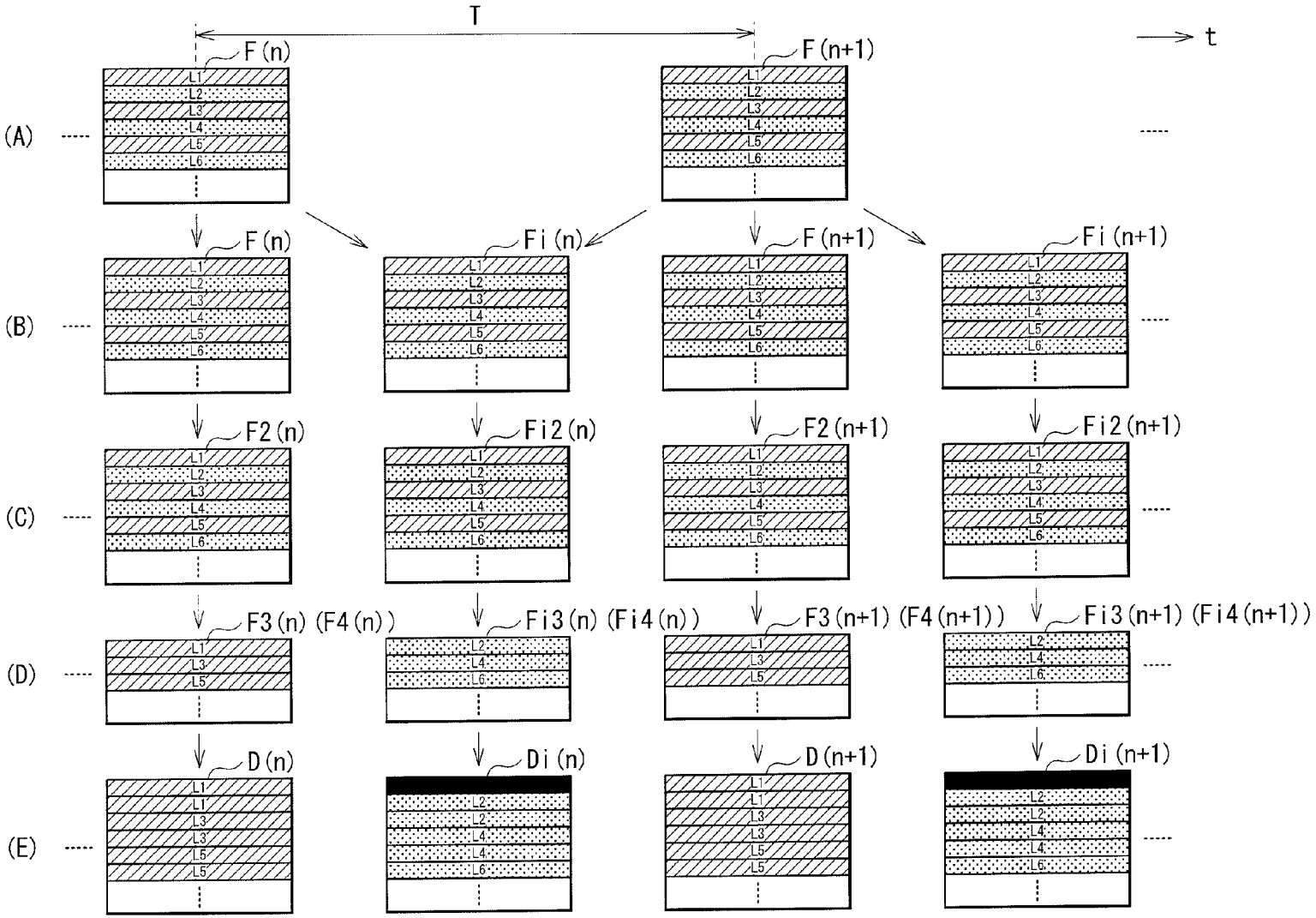

(A), (B), (C), (D), and (E) of FIG. 6 are each a schematic diagram showing an operation example of the display illustrated in FIG. 1.

Figure 7A:
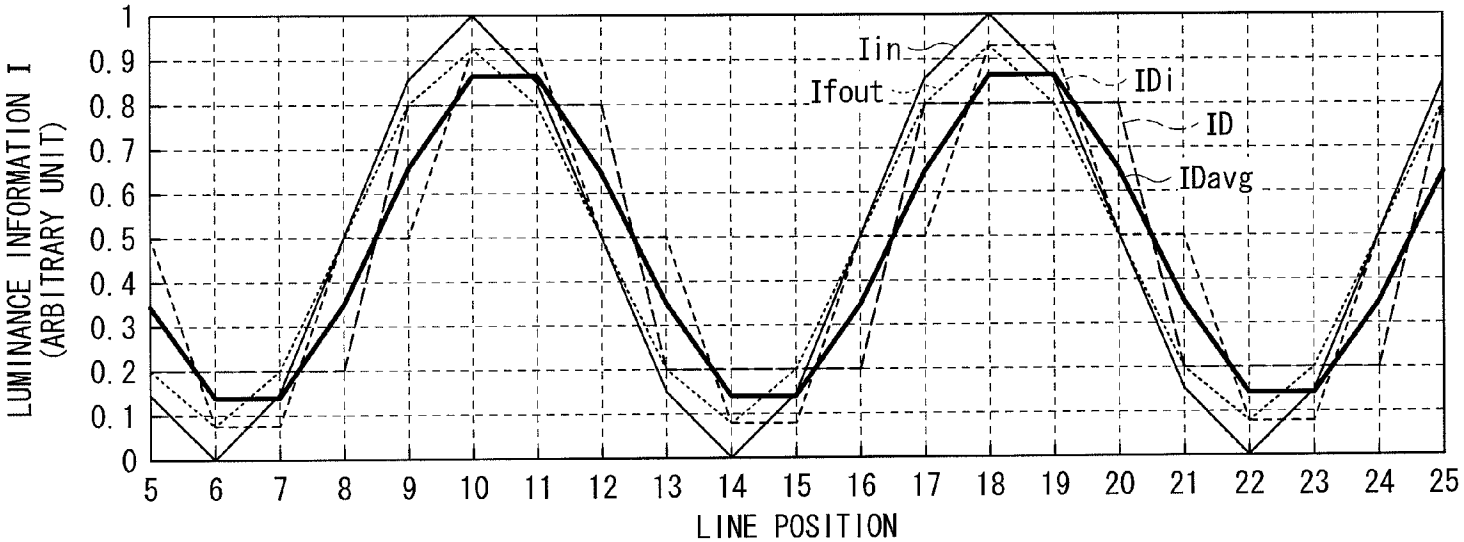
Figure 7B:
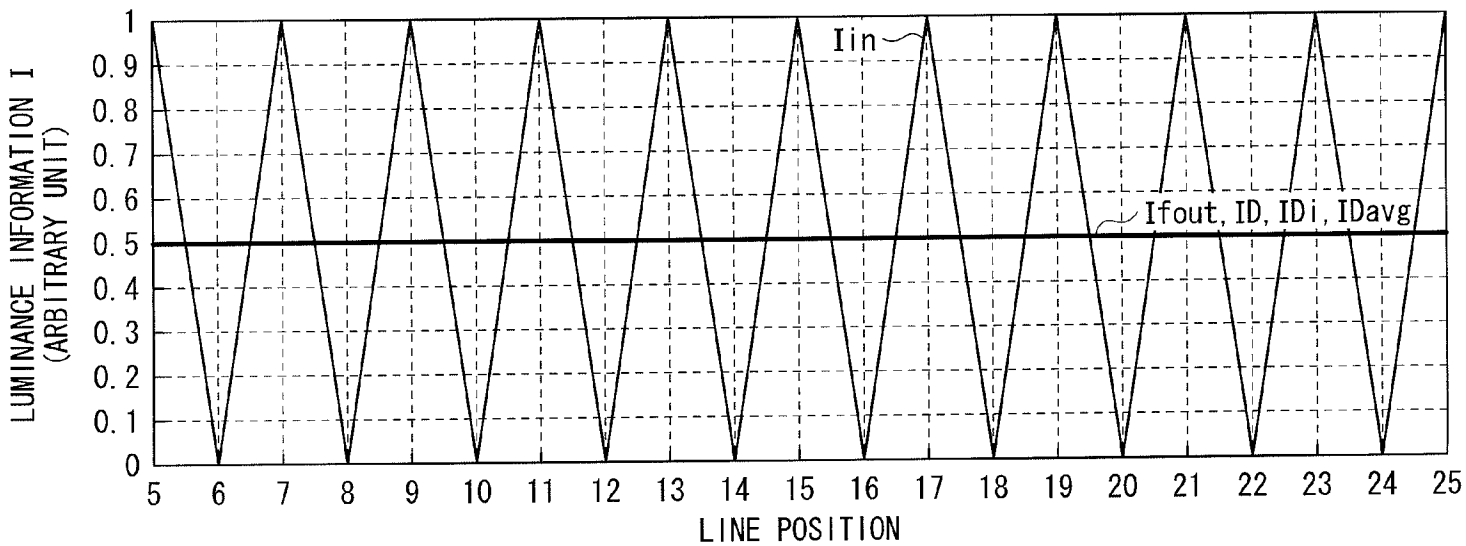

FIGS. 7A and 7B are each an explanatory diagram showing an example of characteristics of the display illustrated in FIG. 1.

Figure 8A:
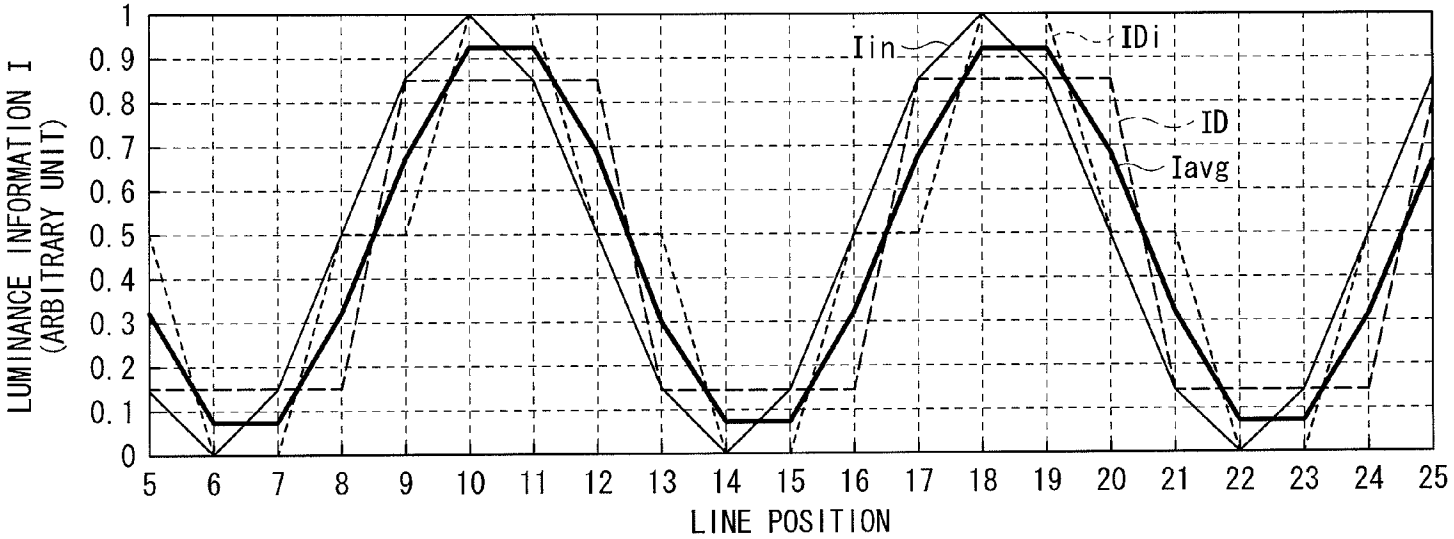
Figure 8B:
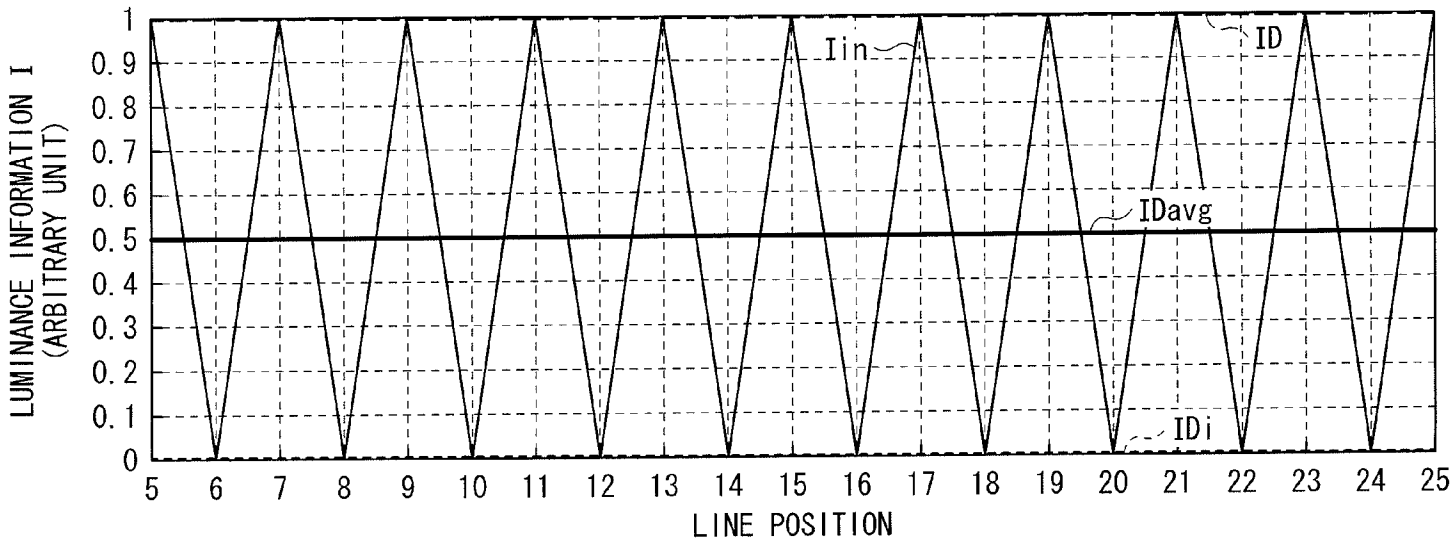

FIGS. 8A and 8B are each an explanatory diagram showing an example of characteristics of a display according to a comparative example of the first embodiment of the present disclosure.

Figure 9:
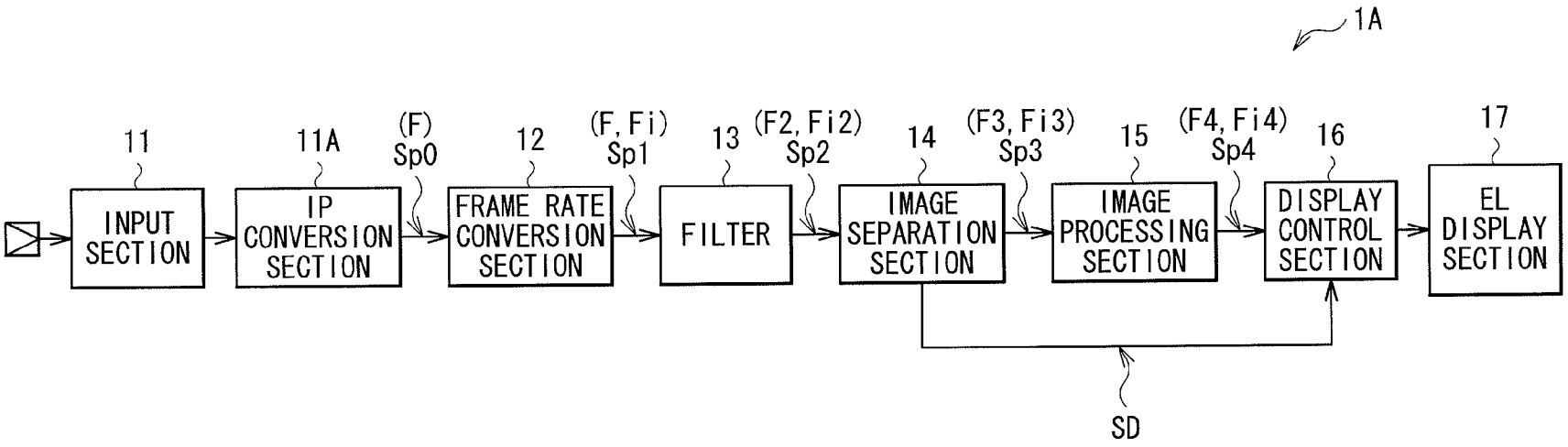

FIG. 9 is a block diagram showing a configuration example of a display according to a modification example of the first embodiment of the present disclosure.

Figure 10:
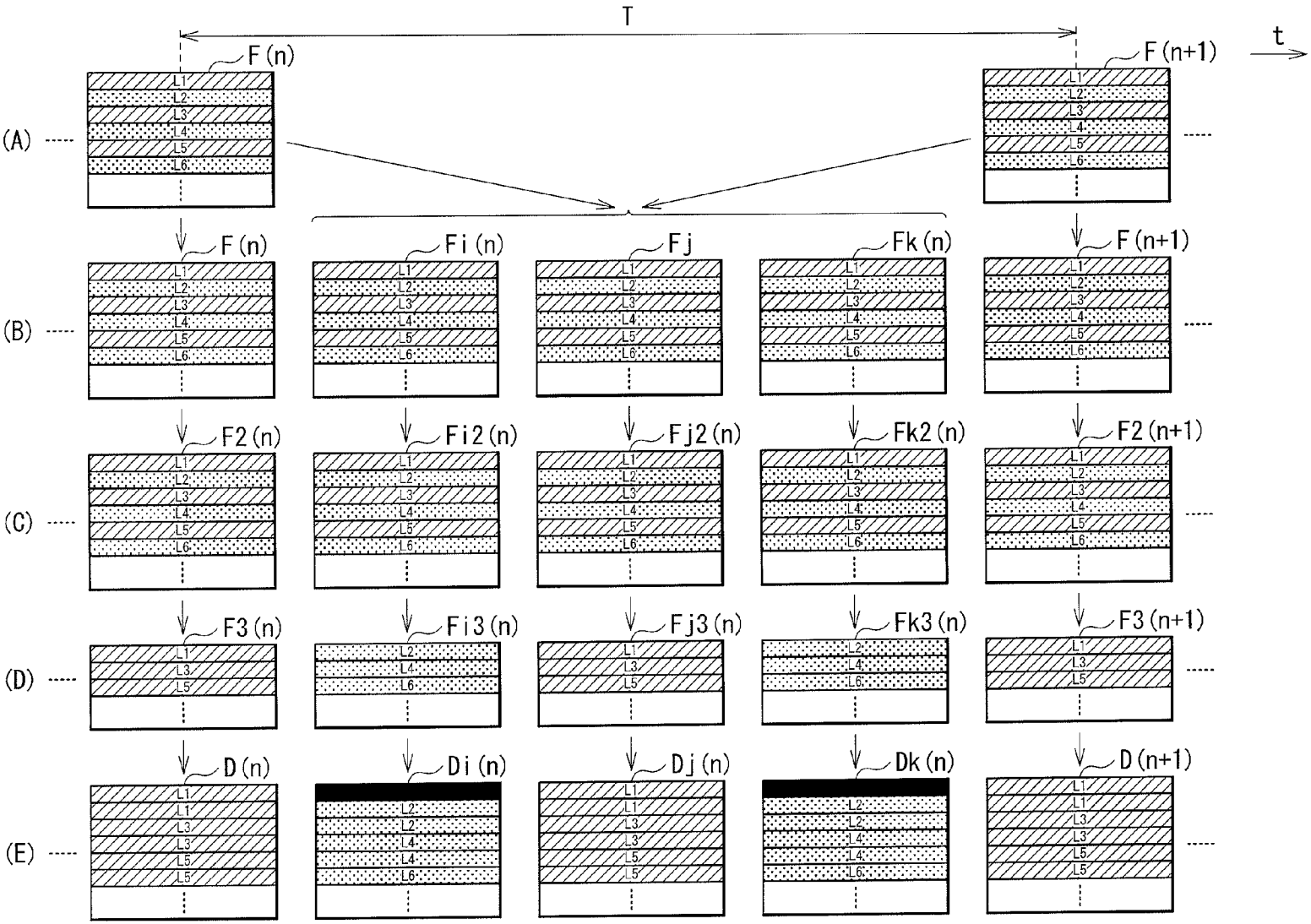

(A), (B), (C), (D), and (E) of FIG. 10 are each a schematic diagram showing an operation example of a display according to another modification example of the first embodiment of the present disclosure.

Figure 11:
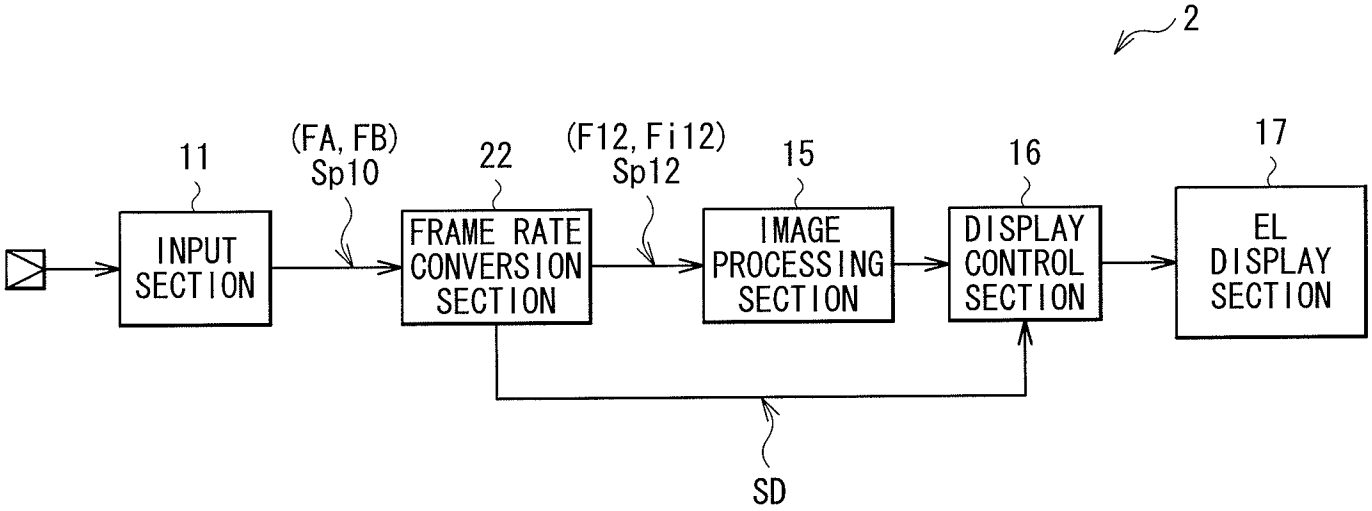

FIG. 11 is a block diagram showing a configuration example of a display according to a second embodiment of the present disclosure.

Figure 12:
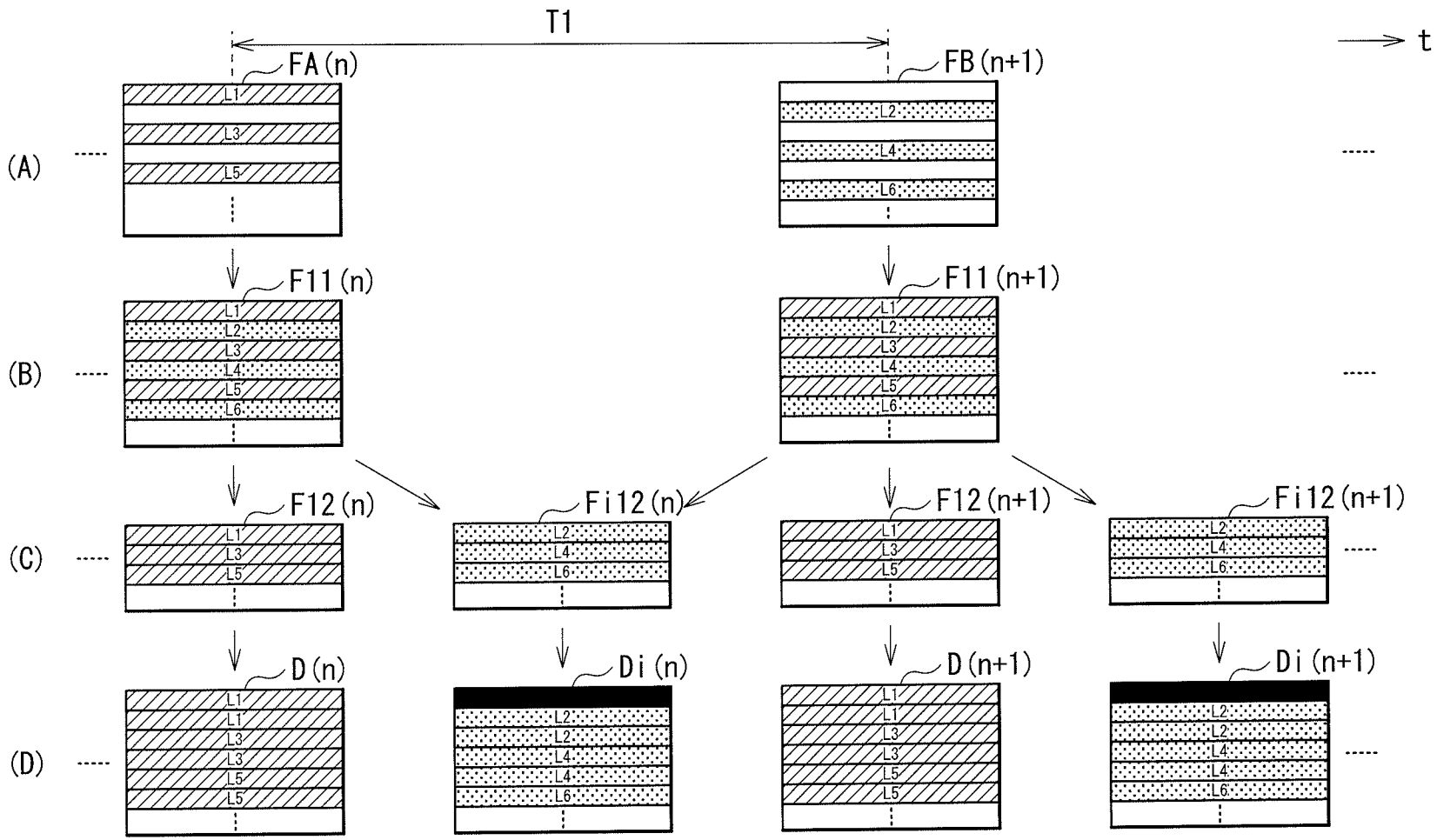

(A), (B), (C), and (D) of FIG. 12 are each a schematic diagram showing an operation example of the display illustrated in FIG. 11.

Figure 13:
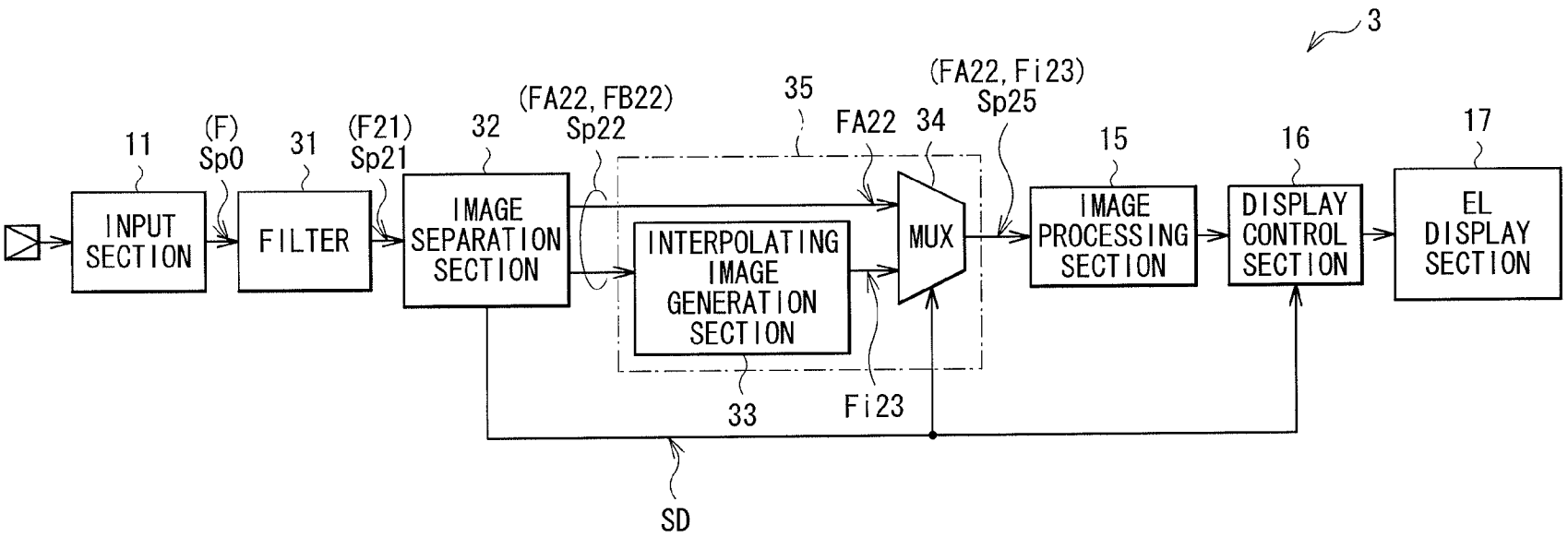

FIG. 13 is a block diagram showing a configuration example of a display according to a third embodiment of the present disclosure.

Figure 14:
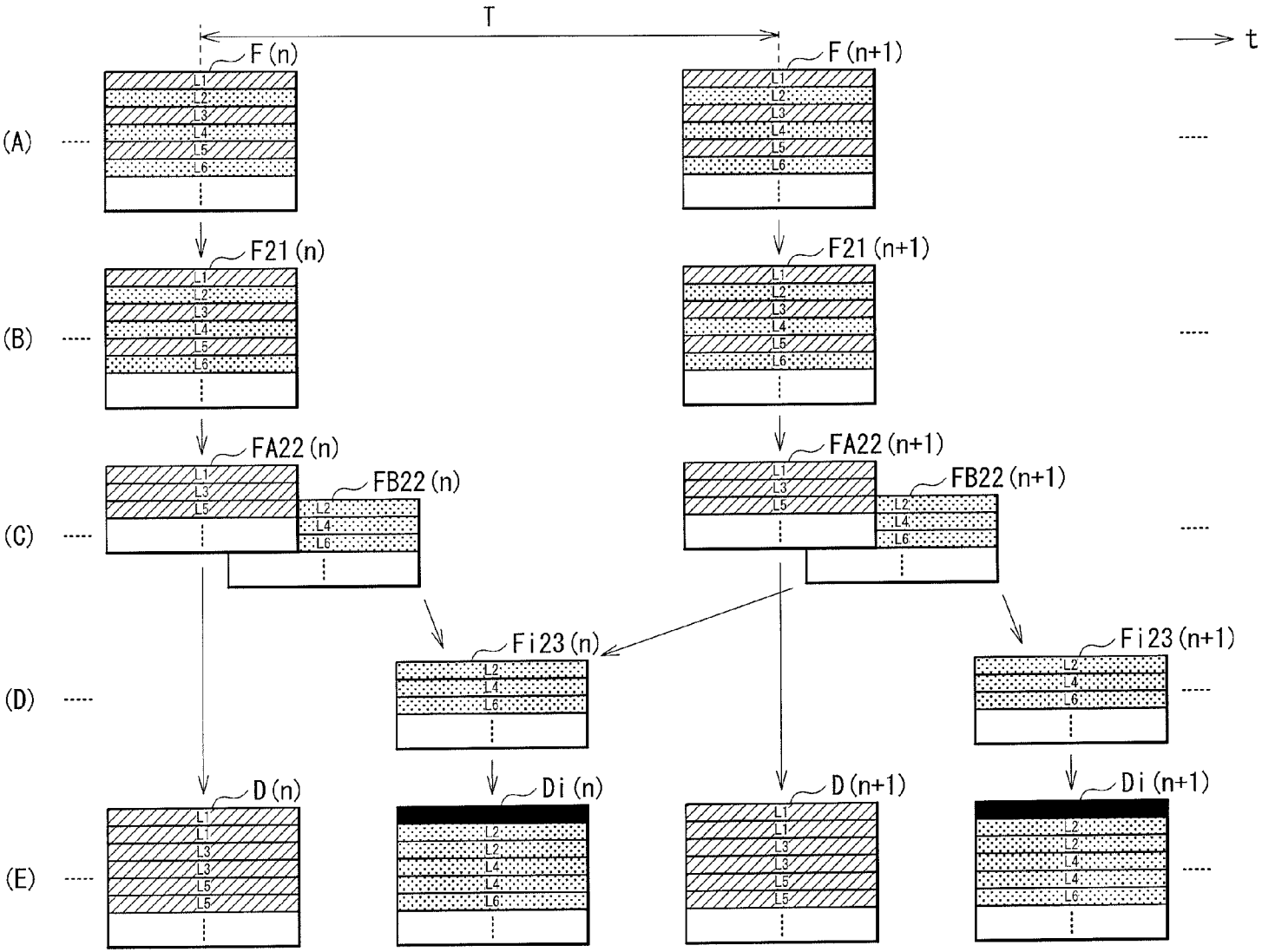

(A), (B), (C), (D), and (E) of FIG. 14 are each a schematic diagram showing an operation example of the display illustrated in FIG. 13.

Figure 15:
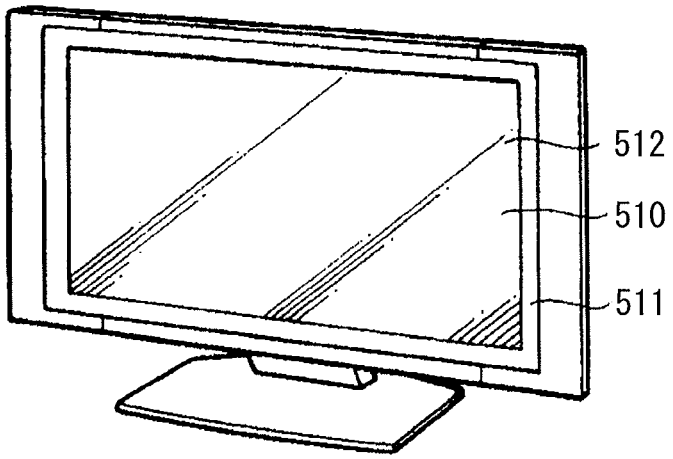

FIG. 15 is a perspective view showing an external appearance configuration of a television receiver to which the display according to the respective embodiments of the present disclosure is applied.

Figure 16A:
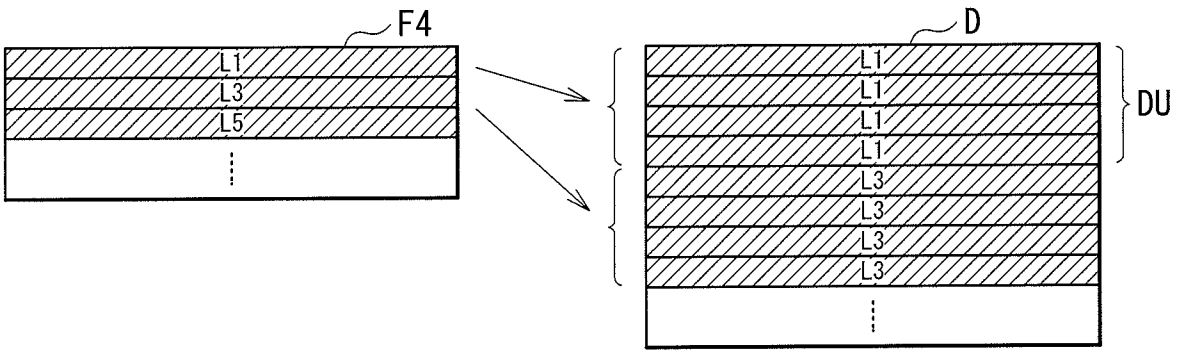
Figure 16B:
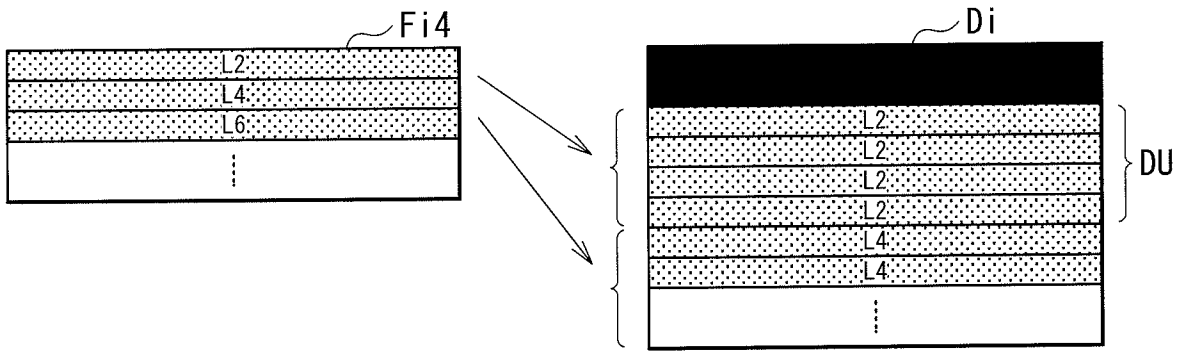

FIGS. 16A and 16B are each a schematic diagram showing an operation example of a display control section according to a modification example.

Figure 17:
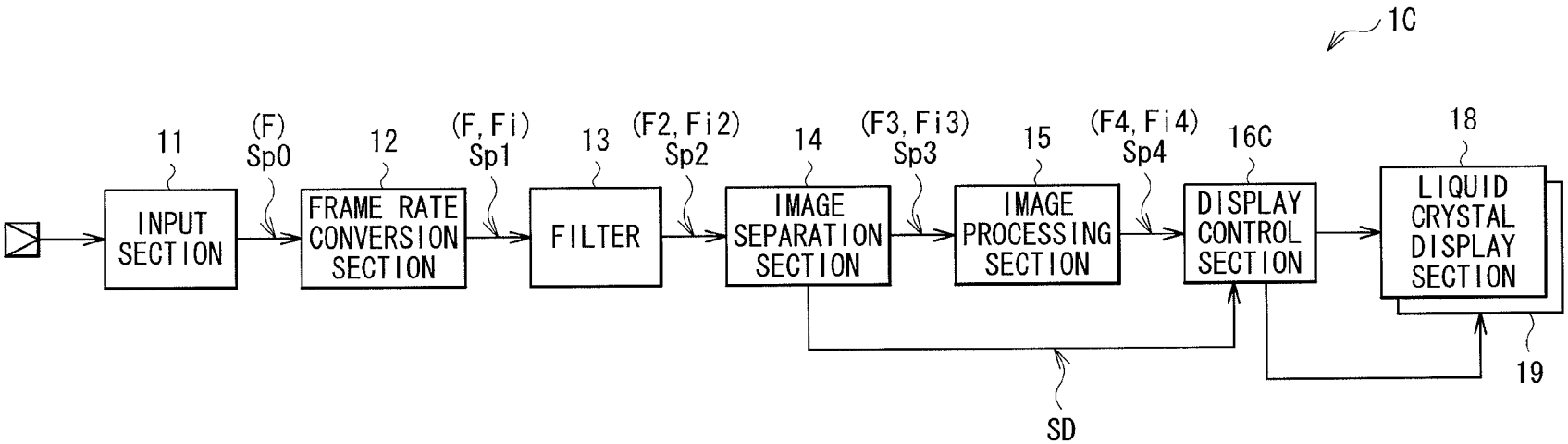

FIG. 17 is a block diagram showing a configuration example of a display according to a modification example.

DETAILED DESCRIPTION

Hereinafter, some embodiments of the present disclosure are described in details with reference to the drawings. It is to be noted that the descriptions are provided in the order given below.

1. First Embodiment
2. Second Embodiment
3. Third Embodiment
4. Application Example

1. First Embodiment

Configuration Example

FIG. 1 shows a configuration example of a display according to a first embodiment of the present disclosure. The display 1 is an EL display that uses organic EL display devices as display devices. It is to be noted that the image processing unit and the display method according to the embodiments of the present disclosure are also described together because they are embodied with this embodiment of the present disclosure.

The display 1 includes an input section 11, a frame rate conversion section 12, a filter 13, an image separation section 14, an image processing section 15, a display control section 16, and an EL display section 17.

The input section 11 is an input interface, and generates and outputs an image signal Sp0 based on an image signal provided from an external apparatus. In this example, an image signal to be supplied to the display 1 is a progressive signal with a frame rate of approximately 60 frames/second. It is to be noted that a frame rate of the image signal to be supplied is not limited thereto, and for example, a frame rate of approximately 50 frames/second may be permitted alternatively.

The frame rate conversion section 12 generates an image signal Sp1 by performing a frame rate conversion based on the image signal Sp0 supplied from the input section 11. In this example, such a frame rate conversion is a twofold frame rate conversion from approximately 60 frames/second into approximately 120 frames/second.

Figure 2A:
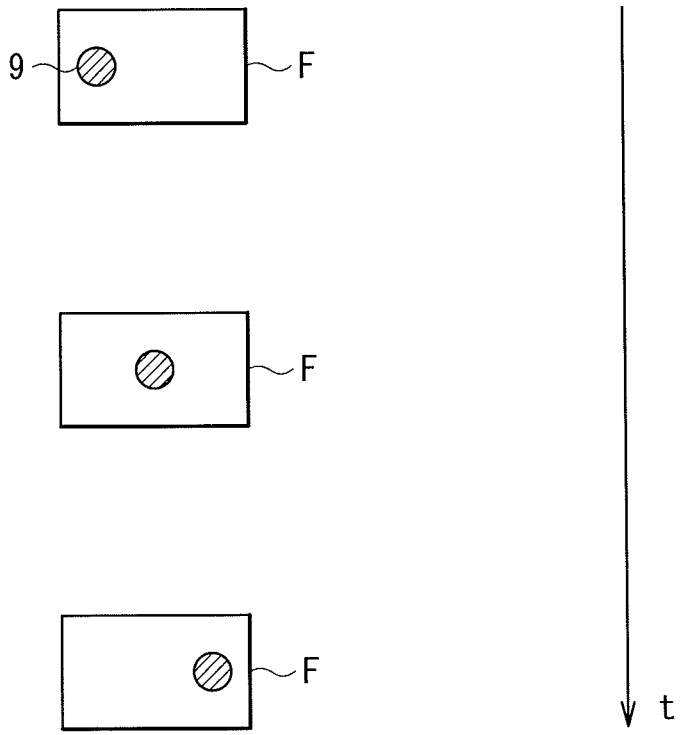
FIGS. 2A and 2B are each a schematic diagram showing an operation example of a frame rate conversion section illustrated in FIG. 1.
Figure 2B:
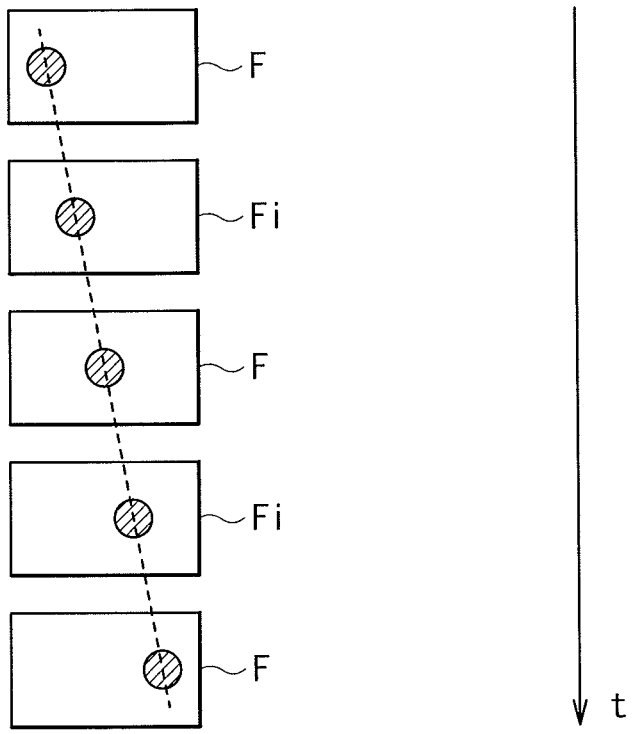

Each of FIGS. 2A and 2B schematically illustrates a frame rate conversion, and FIG. 2A shows an image before the frame rate conversion, while FIG. 2B shows an image after the frame rate conversion. The frame rate conversion is carried out in such a manner that a frame image Fi is generated by an interpolation processing on a time axis based on two frame images F adjoining on a time axis, and the frame image Fi is inserted between those frame images F. Here, the frame images F and Fi are images each composed of luminance information equivalent in quantity to the number of pixels on the EL display section 17. For example, as illustrated in FIG. 2A, in the case of an image showing a movement of a ball 9 from the left to the right, the ball 9 becomes to move more smoothly by inserting the frame image Fi between the adjoining frame images F as illustrated in FIG. 2B. In the EL display section 17, a pixel state is remained during a single frame period, resulting in occurrence of so-called a hold-blur. However, insertion of the frame image Fi allows such an influence to be reduced.

The filter 13 generates frame images F2 and Fi2 respectively by smoothing luminance information for each pixel among lines for the frame images F and Fi that are included in the image signal Sp1, and outputs the resultant frame images F2 and Fi2 as an image signal Sp2. In concrete terms, the filter 13 is composed of a three-tap FIR (Finite Impulse Response) filter in this example. Hereinafter, the description is provided on a case where smoothing is performed on the frame image F as an example. It is to be noted that the description is also the same for a case where smoothing is performed on the frame image Fi.

FIG. 3 shows an operation of the filter 13. A filter coefficient of each tap is set to a ratio of approximately 1:2:1 in this example. The filter 13 performs smoothing on luminance information of three adjoining lines in the frame image F to generate the luminance information for a single line. More specifically, the filter 13 performs weighting of approximately 1:2:1 respectively on the luminance information of three lines L(n−1), L(n), and L(n+1) to generate a line image L(n) for the frame image F2. Similarly, the filter 13 performs weighting of approximately 1:2:1 respectively on the luminance information on three lines L(n), L(n+1), and L(n+2) to generate a line image L(n+1) for the frame image F2. In such a manner, the filter 13 performs smoothing on the frame image F to generate the frame image F2.

The image separation section 14 separates an image F3 from the frame image F2 included in the image signal Sp2, while separates an image Fi3 from the frame image Fi2 included in the image signal Sp2, thereby outputting the resultant images as an image signal Sp3.

Each of FIGS. 4A and 4B illustrates an operation of the image separation section 14, and FIG. 4A shows an operation to separate the image F3 from the frame image F2, while FIG. 4B shows an operation to separate the image Fi3 from the frame image Fi2. As shown in FIG. 4A, the image separation section 14 separates odd-numbered line images L from the frame image F2 included in the image signal Sp2 to generate the image F3 composed of these odd-numbered line images L. Specifically, the image F3 is composed of a first line image L1, a third line image L3, a fifth line image L5, and the like in the frame image F2, and the number of lines of the image F3 is half as many as the number of lines of the image F2. Similarly, as shown in FIG. 4B, the image separation section 14 separates even-numbered line images L from the frame image Fi2 included in the image signal Sp2 to generate the image Fi3 composed of these odd-numbered line images L. Specifically, the image Fi3 is composed of a second line image L2, a fourth line image L4, a sixth line image L6, and the like in the frame image Fi2, and the number of lines of the image Fi3 is half as many as the number of lines of the image Fi2.

Further, the image separation section 14 also has a function to generate a determination signal SD indicating whether the generated image is either the image F3 or Fi3 at the time of separating and generating the images F3 and Fi3 as described above. In other words, the determination signal SD indicates whether the image generated by the image separation section 14 is the image F3 composed of the odd-numbered line images L in the frame image F2 or the image Fi3 composed of the even-numbered line images L in the frame image Fi2.

The image processing section 15 performs predetermined image processing, such as color gamut enhancement and contrast enhancement based on the image signal Sp3 to output the resultant images as an image signal Sp4. In concrete terms, the image processing section 15 generates an image F4 by performing the predetermined image processing on the image F3 included in the image signal Sp3, and generates an image Fi4 by performing the predetermined image processing on the image Fi3 included in the image signal Sp3, thereby outputting the resultant images as the image signal Sp4.

The display control section 16 controls a display operation in the EL display section 17 based on the image signal Sp4 and the determination signal SD. More specifically, in controlling the EL display section 17 based on the images F4 and Fi4 that are included in the image signal Sp4, the display control section 16 takes control to ensure that different scan driving is performed for each of the images F4 and Fi4 in accordance with the determination signal SD.

Figure 5A:
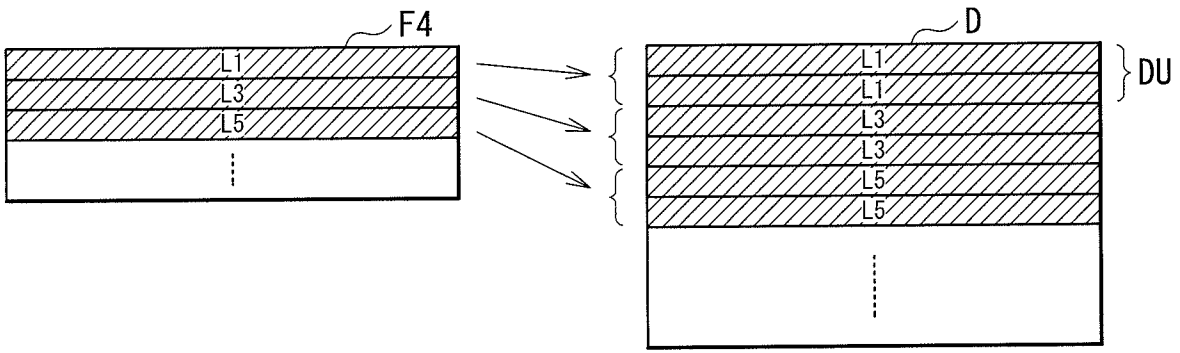
FIGS. 5A and 5B are each a schematic diagram showing an operation example of a display control section illustrated in FIG. 1.
Figure 5B:
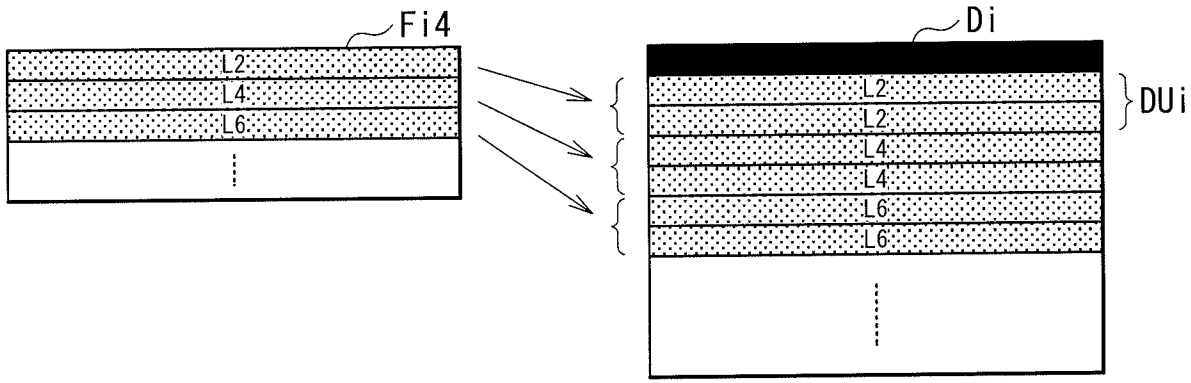

Each of FIGS. 5A and 5B schematically illustrates a control operation of the display control section 16, and FIG. 5A shows a case where the image F4 is displayed, while FIG. 5B shows a case where the image Fi4 is displayed. First, the display control section 16 determines whether an image supplied from the image signal Sp4 is either the image F4 or Fi4 in accordance with the determination signal SD. If the display control section 16 determines that the image F4 is supplied, then it takes control in such a manner that the line image L1 is written into first and second lines on the EL display section 17 within a certain horizontal period, the line image L3 is written into third and fourth lines on the EL display section 17 within another certain horizontal period, and the remaining line images are also written in the same way as above, as shown in FIG. 5A. In other words, the display control section 16 takes control to perform scanning for every two lines (for each driving unit DU) in the EL display section 17. Alternatively, if the display control section 16 determines that the image Fi4 is supplied, then it takes control in such a manner that, for example, black information (in which luminance information is 0) is written into the first line on the EL display section 17, the line image L2 is written into the second and third lines on the EL display section 17 within the same horizontal period, the line image L4 is written into the fourth and fifth lines on the EL display section 17 within the same horizontal period, and the remaining line images are also written in the same way as above, as shown in FIG. 5B. In other words, the display control section 16 controls to perform scanning for every two lines (for each driving unit DUi) in the EL display section 17.

At this time, as shown in FIGS. 5A and 5B, the display control section 16 takes control in such a manner that the driving unit DU for displaying the image F4 is shifted from the driving unit DUi for displaying the image Fi4. Specifically, the driving unit DU corresponds to, for example, the first and second lines on the EL display section 17, while the driving unit DUi corresponds to, for example, the second and third lines on the EL display section 17, and thus they are shifted from each other by a single line. In the display 1, as described later, this makes it possible to suppress any deterioration in the resolution in a vertical direction.

The EL display section 17, which is a display section using organic EL display devices as display devices, performs a display operation under control from the display control section 16.

Here, the display control section 16 corresponds to a specific but not limitative example of a "display driving section" of the present disclosure. The driving unit DU corresponds to a specific but not limitative example of a "first block" the present disclosure, while the driving unit DUi corresponds to a specific but not limitative example of a "second block" of the present disclosure. The frame rate conversion section 12, the filter 13, and the image separation section 14 correspond to a specific but not limitative example of an "image generating section" of the present disclosure. The images F3 and F4 correspond to a specific but not limitative example of a "first image data set" of the present disclosure, while the images Fi3 and Fi4 correspond to a specific but not limitative example of a "second image data set" of the present disclosure. The images F and F2 correspond to a specific but not limitative example of a "third image data set" of the present disclosure, while the images Fi and Fi2 correspond to a specific but not limitative example of a "fourth image data set" of the present disclosure.

Operation and Function

Subsequently, the description is provided on an operation and a function of the display 1 according to the first embodiment of the present disclosure.

Overview of Overall Operation

First, an overall operation of the display 1 is outlined with reference to FIG. 1. The input section 11 generates the image signal Sp0 based on an image signal supplied from an external apparatus. The frame rate conversion section 12 performs a frame rate conversion based on the image signal Sp0 to generate the image signal Sp1 in which the frame images F and the frame images Fi are arrayed alternately. The filter 13 generates the frame images F2 and Fi2 respectively by smoothing luminance information in the frame images F and Fi among lines. The image separation section 14 separates the image F3 from the frame image F2, while separates the image Fi3 from the frame image Fi2, and generates the determination signal SD. The image processing section 15 generates the images F4 and Fi4 respectively by performing predetermined image processing on the images F3 and Fi3. The display control section 16 controls a display operation in the EL display section 17 based on the images F4 and Fi4, as well as the determination signal SD. The EL display section 17 performs a display operation under control from the display control section 16.

Detailed Operation

FIG. 6 schematically illustrates a detailed operation of the display 1. (A) of FIG. 6 shows the frame image F included in the image signal Sp0, (B) shows the frame images F and Fi included in the image signal Sp1, (C) shows the frame images F2 and Fi2 included in the image signal Sp2, (D) shows the frame images F3 and Fi3 included in the image signal Sp3, and (E) shows display images D and Di on the EL display section 17. Here, for example, F(n) denotes the n-th frame image F, and F(n+1) denotes the (n+1)-th frame image F that is supplied next to the frame image F(n). Further, the frame image F is supplied at a cycle T (for example, approximately 16.7 [msec]=approximately 1/60 [Hz]).

First, as shown in (B) of FIG. 6, the frame rate conversion section 12 performs a twofold conversion of a frame rate on the image signal Sp0. In concrete terms, for example, the frame rate conversion section 12 generates the frame image Fi(n) by interpolation processing ((B) of FIG. 6) in accordance with the frame images F(n) and F(n+1) that are adjacent to each other on a time axis and are included in the image signal Sp0 ((A) of FIG. 6). Subsequently, the frame rate conversion section 12 inserts the frame image Fi(n) between the frame images F(n) and F(n+1).

Next, as shown in (C) of FIG. 6, the filter 13 generates the frame images F2 and Fi2 respectively by smoothing luminance information in the frame images F and Fi among lines. More specifically, for example, the filter 13 generates the frame image F2(*n*) by performing smoothing on the frame image F(n) ((B) of FIG. 6), while generates the frame image Fi2(*n*) by performing smoothing on the frame image Fi(n) ((B) of FIG. 6).

Subsequently, as shown in (D) of FIG. 6, the image separation section 14 separates the odd-numbered line images L in the frame image F2, while separating the even-numbered line images L in the frame image Fi2. In concrete terms, for example, the image separation section 14 separates the odd-numbered line images L1, L3, L5, and the like in the frame image F2(*n*) ((C) of FIG. 6) to generate the frame image F3(*n*), and separates the even-numbered line images L2, L4, L6, and the like in the frame image Fi2(*n*) ((C) of FIG. 6) to generate the frame image Fi3(*n*).

Thereafter, the image processing section 15 generates the frame images F4 and Fi4 respectively by performing predetermined image processing on the frame images F3 and Fi3 ((D) of FIG. 6).

Afterward, as shown in (E) of FIG. 6, the display control section 16 controls a display operation in the EL display section 17 in accordance with the frame images F4 and Fi4, as well as the determination signal SD. In concrete terms, for example, the display control section 16 takes control in such a manner that the line image L1 is written into first and second lines on the EL display section 17 within a certain horizontal period, the line image L3 is written into third and fourth lines on the EL display section 17 within another certain horizontal period, and the remaining line images are also written in the same way as above in accordance with the determination signal SD as well as the image F4 (*n*) including the odd-numbered line images L1, L3, and L5 ((D) of FIG. 6), and the EL display section 17 displays the display image D (n) under such a control ((E) of FIG. 6). Similarly, the display control section 16 takes control in such a manner that, for example, black information (in which luminance information is 0) is written into the first line on the EL display section 17, the line image L2 is written into the second and third lines on the EL display section 17 within a certain same horizontal period, the line image L4 is written into the fourth and fifth lines on the EL display section 17 within another certain horizontal period, and the remaining line images are also written in the same way as above in accordance with the determination signal SD as well as the image Fi4 (*n*) including the even-numbered line images L2, L4, and L6 ((D) of FIG. 6), and the EL display section 17 displays the display image Di (n) under such a control ((E) of FIG. 6).

As described above, in the display 1, scan driving is performed for every two lines in accordance with the odd-numbered line images L in the frame image F to display the display image D, and scan driving, which is shifted from the scan driving related to the frame image F by a single line, is performed for every two lines in accordance with the even-numbered line images L in the frame image Fi that is generated by the interpolation processing, to display the display image Di. The display images D and Di are alternately displayed. As a result, a viewer views an average image between the display images D and Di.

On this occasion, in the display 1, scan driving is performed for every two lines, and thus a time length of each horizontal period is assured even when, for example, a high-definition display is utilized as the EL display section 17. Therefore, deterioration in the image quality is suppressed. In other words, for example, when scan driving is performed for each line, it is not possible to adequately assure a horizontal period because the higher a resolution of the display section is, the shorter a horizontal period is, which could lead to deterioration in the image quality. On the contrary, in the display 1, scan driving is performed for every two lines, and thus a longer horizontal period is assured, which allows a possibility of deterioration in the image quality to be reduced.

Further, in the display 1, the driving units DU and DUi are shifted from each other, and the display images D and Di that are shifted from each other by a single line are displayed alternately, which allows deterioration in the resolution to be suppressed as described later.

Additionally, in the display 1, the image separation section 14 generates the images F3 and Fi3 with the number of lines reduced by half, and the image processing section 15 performs predetermined image processing on these images F3 and Fi3, which makes it possible to reduce a burden of the image processing operation in the image processing section 15 in comparison with a case where image processing is performed on any image without the number of lines reduced by half, that is, any image composed of luminance information equivalent in quantity to the number of pixels of the EL display section 17.

Operation of Filter 13

Next, an operation of the filter 13 is described. The filter 13 smoothes among lines the luminance information for each pixel in the frame images F and Fi. For example, in the case where a space frequency of the luminance information in a vertical direction is high, this allows deterioration in the image quality to be suppressed as described hereinafter.

Each of FIGS. 7A and 7B shows an operation of the display 1 when still images are dealt. This example illustrates the luminance information in an output of the filter 13 (filter output luminance Ifout), the luminance information in the display image D (display luminance ID), the luminance information in the display image Di (display luminance IDi), and an average value of the display luminance ID and display luminance IDi (average display luminance IDavg) when the luminance information (input luminance Iin) that varies at a constant cycle with respect to a vertical direction is input to the filter 13. FIG. 7A shows a case where the input luminance Iin varies at eight-line cycle, while FIG. 7B shows a case where the input luminance Iin varies at two-line cycle. In other words, FIG. 7B illustrates a case where the space frequency of the luminance information in a vertical direction is high. Further, a filter coefficient of each tap of the filter 13 is set to a ratio of approximately 1:2:1 in this example.

First, the description is provided on a case where the space frequency is not very high (FIG. 7A). The filter 13 smoothes the input luminance Iin to generate filter output luminance Ifout. Then, the luminance information I in the odd-numbered lines out of the filter output luminance Ifout is scan-driven for every two lines to be displayed (display luminance ID), and similarly the luminance information I in the even-numbered lines out of the filter output luminance Ifout is scan-driven for every two lines to be displayed (display luminance IDi). A viewer perceives an average value of the display luminance ID and the display luminance IDi (average display luminance IDavg).

The average display luminance IDavg takes a form similar to that of the input luminance Iin as compared with the display luminance ID and the display luminance IDi, which allows deterioration in the image quality to be suppressed. In other words, in the display 1, although the display images D and Di are displayed alternately as shown in FIG. 6, for example, when only the display image D is displayed or only the display image Di is displayed, the image quality may deteriorate. More specifically, when only the display image D is displayed, a viewer perceives the display luminance ID (FIG. 7A), and when only the display image Di is displayed, a viewer perceives the display luminance IDi (FIG. 7A). In these cases, since the resolution is reduced by half due to a scan driving for every two lines, a form of the display luminance ID is different from that of the input luminance Iin, which may lead to deterioration in the image quality. On the contrary, in the display 1, the display images D and Di that are shifted from each other by a single line are displayed alternately, which makes it possible to suppress deterioration in the resolution as well as in the image quality.

Next, the description is provided on a case where the space frequency is high (FIG. 7B). In this case, the filter 13 smoothes the input luminance Iin to generate the almost constant filter output luminance Ifout. As a result, the display luminance ID and the display luminance IDi, as well as the average display luminance IDavg also become almost constant.

In this case, the average display luminance IDavg takes a form that is significantly different from that of the input luminance Iin. However, since a human's visual resolution is not fully high, a viewer is generally unable to perceive the luminance information I of such a high space frequency, but a viewer perceives average luminance of a plurality of lines, and thus this doesn't matter in most cases.

Further, when the space frequency is high as described above, provision of the filter 13 allows a possibility of flickering to be reduced as described hereinafter in comparison with a comparative example.

Comparative Example

Next, a function of the first embodiment of the present disclosure is described in contrast with a comparative example. A display 1R according to the comparative example is not provided with the filter 13. Any other configuration is the same as with the first embodiment of the present disclosure (FIG. 1).

Each of FIGS. 8A and 8B illustrates an operation of the display 1R, and FIG. 8A shows a case where the input luminance Iin varies at eight-line cycle, while FIG. 8B shows a case where the input luminance Iin varies at two-line cycle. In other words, FIGS. 8A and 8B respectively correspond to FIGS. 7A and 7B (for the case of the display 1 according to the first embodiment of the present disclosure).

When the space frequency is not very high (FIG. 8A), as with a case of the display 1 (FIG. 7A), it is possible to have the average display luminance IDavg in the form similar to the input luminance Iin, which allows deterioration in the image quality to be suppressed.

When the space frequency is high (FIG. 8B), flickering may occur, and accordingly the image quality may deteriorate. In other words, in this example, the display luminance ID becomes constant at the luminance information I in the odd-numbered lines in the input luminance Iin, while the display luminance IDi becomes constant at the luminance information I in the even-numbered lines in the input luminance Iin. Accordingly, when the frame image F is a stripe in which white colors and black colors are arrayed alternately for each line, the display image D with only a white color in a whole area and the display image Di with only a black color in a whole area are displayed alternately at approximately 60 [Hz], which could make a viewer feel blinking (flickering).

On the contrary, in the display 1 according to the first embodiment of the present disclosure, provision of the filter 13 ensures that the luminance information is smoothed among lines when the space frequency is high, which makes it possible to reduce a possibility that flickering occur.

In this example, a case where the input luminance Iin varies at two-line cycle is considered as an example where the space frequency is high. However, when only images having a lower space frequency are to be processed, it may be permitted to weaken the effect of smoothing in such a manner that a filter coefficient for each tap of the filter 13 is set to approximately 1:6:1 for example. In this case, in an example in FIG. 7A, it is possible to bring a form of the average display luminance IDavg close to that of the input luminance Iin, which allows the image quality to be enhanced.

Advantageous Effects

As described above, in the first embodiment of the present disclosure, scan driving is performed for every two lines, and thus a time length of each horizontal period is assured, which allows deterioration in the image quality to be suppressed.

Further, in the first embodiment of the present disclosure, the driving units DU and DUi are shifted from each other, and thus the display images D and Di that are shifted from each other by a single line are displayed alternately, which makes it possible to suppress the deterioration in the resolution as well as in the image quality.

Additionally, in the first embodiment of the present disclosure, the image separation section generates images with the number of lines reduced by half, and the image processing section performs predetermined image processing on the images, which allows a burden of an image processing operation in the image processing section to be reduced.

Moreover, in the first embodiment of the present disclosure, provision of the filter ensures to reduce a possibility that flickering occur, as well as to suppress deterioration in the image quality.

Modification Example 1-1

In the above-described first embodiment of the present disclosure, although an image signal to be supplied to the display 1 is a progressive signal, such an image signal is not limited thereto, and alternatively, as shown in FIG. 9, for example, a configuration may be made that allows an interlace signal to be input by providing an IP (Interlace/Progressive) conversion section 11A.

Modification Example 1-2

In the above-described first embodiment of the present disclosure, although the frame rate conversion section 12 performs a twofold frame rate conversion, the frame rate conversion is not limited thereto, and alternatively as shown in FIG. 10, for example, a fourfold frame rate conversion may be permitted. In the present modification example, the frame rate conversion is carried out in such a manner that three pieces of frame images Fi, Fj, and Fk are generated by interpolation processing based on the frame images F that are adjacent to each other on a time axis, and the frame images Fi, Fj, and Fk are inserted between the frame images F.

2. Second Embodiment

Next, the description is provided on a display 2 according to a second embodiment of the present disclosure. In the second embodiment of the present disclosure, a circuit configuration is more simplified by using an interlace signal as an image signal to be supplied. It is to be noted that any component parts essentially same as those of the display 1 according to the above-described first embodiment of the present disclosure are denoted with the same reference numerals, and the related descriptions are omitted as appropriate.

FIG. 11 shows a configuration example of the display 2 according to the second embodiment of the present disclosure. The display 2 includes a frame rate conversion section 22. The frame rate conversion section 22 generates an image signal Sp12 (images F12 and Fi12) by performing a frame rate conversion in accordance with an image signal Sp10 (field images FA and FB) of the supplied interlace signal. Here, the field image FA is a field image related to odd-numbered lines, while the field image FB is a field image related to even-numbered lines. Further, as with the image separation section 14 according to the above-described first embodiment of the present disclosure, the frame rate conversion section 22 also has a function to generate the determination signal SD indicating whether the generated image is either the image F12 or Fi12 at the time of generating the images F12 and Fi12.

Here, the frame rate conversion section 22 corresponds to a specific but not limitative example of an "image generating section" of the present disclosure. The field image FA corresponds to a specific but not limitative example of an "odd-numbered line image data set" of the present disclosure, while the field image FB corresponds to a specific but not limitative example of an "even-numbered line image data set" of the present disclosure.

FIG. 12 schematically illustrates a detailed operation of the display 2, and (A) of FIG. 12 shows the field images FA and FB that are included in the image signal Sp10, (B) shows the images F11 that are generated within the frame rate conversion section 22, (C) shows the images F12 and Fi12 that are included in the image signal Sp12, and (D) shows the display images D and Di on the EL display section 17. The field images FA and FB are supplied alternately at a time cycle of T1 (for example, approximately 16.7 [msec]=approximately 1/60 [Hz]).

First, as shown in (B) of FIG. 12, the frame rate conversion section 22 interpolates line images of the field images FA and FB that are included in the image signal Sp10. In concrete terms, for example, the frame rate conversion section 22 generates the image F11(*n*) ((B) of FIG. 12) by interpolating even-numbered line images in accordance with the field image FA(n) included in the image signal Sp10 ((A) of FIG. 12). Similarly, for example, the frame rate conversion section 22 generates the image F11(*n*+1) ((B) of FIG. 12) by interpolating odd-numbered line images in accordance with the field image FB(n+1) included in the image signal Sp10 ((A) of FIG. 12).

Next, as shown in (C) of FIG. 12, the frame rate conversion section 22 performs a twofold frame rate conversion, while separating even-numbered line images and odd-numbered line images from the image F11. In concrete terms, for example, the frame rate conversion section 22 generates the image F12(*n*) ((C) of FIG. 12) by separating the odd-numbered line images L1, L3, and L5 in the image F11(*n*) ((B) of FIG. 12), and generates the image Fi12(*n*) by interpolation processing in accordance with the even-numbered line images L2, L4, and L6 in the images F11(*n*) and F11(*n*+1) that are adjacent to each other on a time axis ((B) of FIG. 12). Subsequently, the frame rate conversion section 22 inserts the image Fi12(*n*) between the images F12(*n*) and F12(*n*+1) ((C) of FIG. 12).

Subsequently, as with the above-described first embodiment of the present disclosure, the image processing section 15 performs predetermined image processing on the frame images F12 and Fi12, the display control section 16 controls a display operation on the EL display section 17, and the EL display section 17 displays the display images D and Di under control from the display control section 16 ((D) of FIG. 12).

In the display 2, an interlace signal is used as an image signal to be supplied. Accordingly, there is no necessity for providing a filter. In other words, in the display 1 according to the above-described first embodiment of the present disclosure, it is desirable to provide the filter 13 because flickering may occur when a space frequency is high if the filter 13 is not provided ((B) of FIG. 12). On the contrary, in the display 2 according to the second embodiment of the present disclosure, an image signal to be supplied is an interlace signal, and thus such a phenomenon is less likely to occur. This allows a filter to be omitted.

Further, omission of a filter makes it possible to achieve a simplified circuit configuration. Especially, for example, in the display 1 according to the above-described first embodiment of the present disclosure, since it is necessary to perform smoothing on frame images including both of the even-numbered line images and the odd-numbered line images to reduce flickering as described above, there is a necessity to provide the image separation section 15 at a stage following the filter 13. On the contrary, in the display 2 according to the second embodiment of the present disclosure, omission of the filter 13 allows the even-numbered line images and the odd-numbered line images to be separated, while a frame rate conversion is performed on the frame rate conversion section 22, which makes it possible to achieve a simplified circuit configuration.

As described above, in the second embodiment of the present disclosure, an image signal to be supplied is an interlace signal, and thus it is possible to achieve a simplified circuit configuration. Any other advantageous effects are the same as with the above-described first embodiment of the present disclosure.

3. Third Embodiment

Next, the description is provided on a display 3 according to a third embodiment of the present disclosure. In the third embodiment of the present disclosure, a method of converting frame rate is different from that according to the above-described first embodiment of the present disclosure. It is to be noted that any component parts essentially same as those of the display 1 according to the above-described first embodiment of the present disclosure are denoted with the same reference numerals, and the related descriptions are omitted as appropriate.

FIG. 13 shows a configuration example of the display 3 according to the third embodiment of the present disclosure. The display 3 includes a filter 31, an image separation section 32, and a frame rate conversion section 35.

The filter 31 generates a frame image F21 by smoothing among lines the luminance information in the frame image F included in the image signal Sp0 to output the resultant image as an image signal Sp21. A specific operation is the same as with the filter 13.

The image separation section 32 generates an image FA22 by separating odd-numbered line images, and generates an image FB22 by separating even-numbered line images, from the frame image F21 included in the image signal Sp21. Further, as with the image separation section 14 and the like according to the above-described first embodiment of the present disclosure, the image separation section 32 also has a function to generate the determination signal SD indicating whether the generated image is either the image FA22 or FB22 at the time of generating the images FA22 and FB22.

The frame rate conversion section 35 has an interpolating image generating section 33 and a multiplexer (MUX) 34. The interpolating image generating section 33 performs interpolation processing on a time axis in accordance with the image FB22 to generate an image Fi23. The multiplexer 34 arrays the images FA22 and the images Fi23 alternately in accordance with the determination signal SD to output the resultant image as an image signal Sp25.

Here, the filter 31, the image separation section 32, and the frame rate conversion section 35 correspond to a specific but not limitative example of an "image generating section" of the present disclosure. The image FA22 corresponds to a specific but not limitative example of an "odd-numbered line image data set" of the present disclosure, while the image FB22 corresponds to a specific but not limitative example of an "even-numbered line image data set" of the present disclosure.

FIG. 14 schematically illustrates a detailed operation of the display 3, and (A) of FIG. 14 shows the frame image F included in the image signal Sp0, (B) shows the frame image F21 included in the image signal Sp21, (C) shows the images FA22 and FB22 that are included in the image signal Sp22, (D) shows the image Fi23 that is generated by the interpolating image generating section 33, and (E) shows the display images D and Di on the EL display section 17.

First, as shown in (B) of FIG. 14, the filter 31 generates the frame image F21 by smoothing among lines the luminance information in the frame image F included in the image signal Sp0.

Next, as shown in (C) of FIG. 14, the image separation section 32 generates the image FA22 by separating odd-numbered line images, and generates the image FB22 by separating even-numbered line images, from the frame image F21 included in the image signal Sp21.

Subsequently, as shown in (D) of FIG. 14, the frame rate conversion section 35 performs a twofold frame rate conversion. In concrete terms, for example, the interpolating image generating section 33 of the frame rate conversion section 35 generates the frame image Fi23($n$) by interpolation processing ((D) of FIG. 14) in accordance with the images FB22($n$) and FB22($n$+1) that are adjacent to each other on a time axis ((C) of FIG. 14). Then, the multiplexer 34 arrays the images FA22 and the images Fi23 alternately to output the resultant image as the image signal Sp25.

Thereafter, as with the above-described first embodiment of the present disclosure and the like, the image processing section 15 performs predetermined image processing on the frame images FA22 and Fi23, the display control section 16 controls a display operation on the EL display section 17, and the EL display section 17 displays the display images D and Di under control from the display control section 16 ((E) of FIG. 14).

In the display 3, the interpolation processing is performed on either the image FA22 or FB22 (image FB22 in this example) that is separated by the image separation section 32, which makes it possible to reduce an image processing load on the interpolating image generating section 33. In other words, for example, in the display 1 according to the above-described first embodiment of the present disclosure, the interpolation processing is performed on the frame images F including both of the even-numbered line images and the odd-numbered line images, which may cause an image processing load to increase excessively. On the contrary, in the display 3 according to the third embodiment of the present disclosure, as shown in (D) of FIG. 14, the interpolation processing is performed only on the image FB22 including the even-numbered line images in this example, which makes it possible to reduce an image processing load on the interpolating image generating section 33.

As described above, in the third embodiment of the present disclosure, the interpolation processing is performed on either one of the images that are separated by the image separation section, which makes it possible to reduce an image processing burden on the frame rate conversion section. Any other advantageous effects are the same as with the above-described first embodiment of the present disclosure.

4. Application Example

Next, the description is provided on an application example of the displays that are described in the above-described respective embodiments of the present disclosure and the modification examples.

FIG. 15 shows an external appearance of a television receiver to which any of the displays according to the above-described respective embodiments of the present disclosure and the like is applied. This television receiver has an image display screen section 510 including, for example, a front panel 511 and a filter glass 512, and the image display screen section 510 is composed of any one of the displays according to the above-described respective embodiments of the present disclosure and the like.

In addition to such a television receiver, the displays according to the above-described respective embodiments of the present disclosure and the like are applicable to electronic apparatuses in every field, including digital cameras, notebook personal computers, portable terminal devices such as cellular phones, portable game machines, or video cameras. In other words, the displays according to the above-described respective embodiments of the present disclosure and the like are applicable to electronic apparatuses for displaying images in every field.

Although the present technology has been described with reference to some embodiments and modification examples, as well as the application example for electronic apparatuses, the present technology is not limited to the above-described embodiments and the like, and different variations are available.

For example, in the above-described respective embodiments and the like, although scan driving of the EL display section 17 is performed for every two lines, such scan driving is not limited thereto, and alternatively, scan driving of the EL display section 17 may be performed for every three or more lines, as shown in FIGS. 16A and 16B.

Further, for example, in the above-described respective embodiments and the like, although an EL display is configured, the configuration is not limited thereto, and alternatively a liquid crystal display may be configured as shown in FIG. 17, for example. This display 1C is a liquid crystal display to which the display 1 according to the first embodiment of the present disclosure is applied, and includes a liquid crystal display section 18, a backlight 19, and a display control section 16C controlling the liquid crystal display section 18 and the backlight 19.

It is to be noted that the technology may be configured as follows.

(1) A display, including:

a display section; and a display driving section driving the display section based on a first image data set and a second image data set that alternate with each other, wherein the display driving section drives the display section by performing a first scan with use of a first block as a driving unit in accordance with the first image data set and a second scan with use of a second block as a driving unit in accordance with the second image data set, the first block being composed of a plurality of consecutive pixel lines, and the second block being composed of a plurality of consecutive pixel lines and being different from the first block.

(2) The display according to (1), further including an image generating section including a frame rate conversion section that performs a frame rate conversion based on an input image signal and generating the first image data set and the second image data set based on image data subjected to the frame rate conversion.

(3) The display according to (2), wherein the image generating section generates a determination signal indicating whether either the first image data set or the second image data set is generated, and the display driving section selectively performs the first scan or the second scan based on the determination signal.

(4) The display according to (2) or (3), wherein the image generating section further includes an image separation section, the input image signal is a progressive signal, the frame rate conversion section generates a third image data set and a fourth image data set that alternate with each other, by performing the frame rate conversion based on the progressive signal, and the image separation section generates the first image data set by separating odd-numbered line image data based on the third image data set, while generating the second image data set by separating even-numbered line image data based on the fourth image data set.

(5) The display according to (4), wherein the image generating section further includes a filter performing smoothing among pixel lines for each of the third image data set and the fourth image data set, and the image separation section generates the first image data set based on the smoothed third image data set, while generating the second image data set based on the smoothed fourth image data set.

(6) The display according to (4) or (5), wherein each of the third image data set and the fourth image data set is composed of pixel data equivalent in quantity to the number of pixels in the display section.

(7) The display according to any one of (4) to (6), further including a conversion section converting an interlace signal into a progressive signal, wherein the input image signal is the progressive signal converted by the conversion section.

(8) The display according to (2) or (3), wherein the input image signal is an interlace signal including an odd-numbered line image data set and an even-numbered line image data set that alternate with each other, and the frame rate conversion section generates an odd-numbered line interpolation image data set by performing line interpolation processing among pixel lines on the even-numbered line image data set, while generating an even-numbered line interpolation image data set by performing the line interpolation processing among pixel lines on the odd-numbered line image data set, generates the first image data set based on the odd-numbered line image data set and the odd-numbered line interpolation image data set, and generates the second image data set based on the even-numbered line image data set and the even-numbered line interpolation image data set.

(9) The display according to (8), wherein the frame rate conversion section uses the odd-numbered line image data set and the odd-numbered line interpolation image data set as the first image data set, and generates the second image data set by performing interpolation processing on a time axis on the even-numbered line image data set and the even-numbered line interpolation image data set.

(10) The display according to (2) or (3), wherein the input image signal is a progressive signal including a series of input image data sets, the image generating section further includes an image separation section, the image separation section generating an odd-numbered line image data set by separating odd-numbered line image data and generating an even-numbered line image data set by separating even-numbered line image data, based on each of the series of input image data sets, and the frame rate conversion section uses one of the odd-numbered line image data set and the even-numbered line image data set as the first data set, and generates the second image data set by performing interpolation processing on a time axis on the other of the odd-numbered line image data set and the even-numbered line image data set.

(11) The display according to (10), wherein the image generating section further includes a filter performing smoothing among pixel lines for each of a series of the input image data set, and the image separation section generates the odd-numbered line image data set and the even-numbered line image data set based on each of the series of input image data sets that is smoothed.

(12) The display according to (10) or (11), wherein the image generating section generates a determination signal indicating whether either the first image data set or the second image data set is generated, and the frame rate conversion section performs the frame rate conversion based on the determination signal.

(13) The display according to any one of (1) to (12), further including an image processing section performing predetermined image processing on the first image data set and the second image data set, wherein the display driving section drives the display section based on the first image data set subjected to the image processing and the second image data set subjected to the image processing.

(14) The display according to any one of (1) to (13), wherein each of the first image data set and the second image data set is composed of pixel data equivalent in quantity to half of the number of the pixels in the display section.

(15) The display according to any one of (1) to (14), wherein the first block and the second block are both composed of two pixel lines, and the first block is shifted from the second block by a single line.

(16) The display according to any one of (1) to (15), wherein the display section is an EL display section.

(17) An image processing unit, including:

a display driving section driving the display section by performing a first scan with use of a first block as a driving unit in accordance with a first image data set and a second scan with use of a second block as a driving unit in accordance with a second image data set, the first block being composed of a plurality of consecutive pixel lines, the second block being composed of a plurality of consecutive pixel lines and being different from the first block, and the first image data set and the second image data set alternating with each other.

(18) A display method, including:

preparing a first image data set and a second image data set alternating with each other; and driving the display section by performing a first scan with use of a first block as a driving unit in accordance with the first image data set and a second scan with use of a second block as a driving unit in accordance with the second image data set, the first block being composed of a plurality of consecutive pixel lines, and the second block being composed of a plurality of consecutive pixel lines and being different from the first block.

The present disclosure contains subject matter related to that disclosed in Japanese Priority Patent Application JP 2012-127015 filed in the Japan Patent Office on Jun. 4, 2012, the entire content of which is hereby incorporated by reference.

It should be understood by those skilled in the art that various modifications, combinations, sub-combinations, and alterations may occur depending on design requirements and other factors insofar as they are within the scope of the appended claims or the equivalents thereof.

What is claimed is:

1. A display, comprising:

a display section;

a display driving section driving the display section based on a first image data set and a second image data set that alternate with each other; and an image generating section including a frame rate conversion section that performs a frame rate conversion based on an input image signal and generating the first image data set and the second image data set based on image data subjected to the frame rate conversion, wherein the image input signal is a progressive signal, wherein the display driving section drives the display section by performing a first scan with use of a first block as a driving unit in accordance with the first image data set and a second scan with use of a second block as a driving unit in accordance with the second image data set, the first block being composed of a plurality of consecutive pixel lines, and the second block being composed of a plurality of consecutive pixel lines and being different from the first block.

2. The display according to claim 1, wherein the image generating section generates a determination signal indicating whether either the first image data set or the second image data set is generated, and the display driving section selectively performs the first scan or the second scan based on the determination signal.

3. The display according to claim 1, wherein the image generating section further includes an image separation section, the frame rate conversion section generates a third image data set and a fourth image data set that alternate with each other, by performing the frame rate conversion based on the progressive signal, and the image separation section generates the first image data set by separating odd-numbered line image data based on the third image data set, while generating the second image data set by separating even-numbered line image data based on the fourth image data set.

4. The display according to claim 3, wherein the image generating section further includes a filter performing smoothing among pixel lines for each of the third image data set and the fourth image data set, and the image separation section generates the first image data set based on the smoothed third image data set, while generating the second image data set based on the smoothed fourth image data set.

5. The display according to claim 3, wherein each of the third image data set and the fourth image data set is composed of pixel data equivalent in quantity to the number of pixels in the display section.

6. The display according to claim 3, further comprising a conversion section converting an interlace signal into a progressive signal, wherein the input image signal is the progressive signal converted by the conversion section.

7. The display according to claim 1, wherein the input image signal includes a series of input image data sets, the image generating section further includes an image separation section, the image separation section generating an odd-numbered line image data set by separating odd-numbered line image data and generating an even-numbered line image data set by separating even-numbered line image data, based on each of the series of input image data sets, and the frame rate conversion section uses one of the odd-numbered line image data set and the even-numbered line image data set as the first data set, and generates the second image data set by performing interpolation processing on a time axis on the other of the odd-numbered line image data set and the even-numbered line image data set.

8. The display according to claim 7, wherein the image generating section further includes a filter performing smoothing among pixel lines for each of a series of the input image data set, and the image separation section generates the odd-numbered line image data set and the even-numbered line image data set based on each of the series of input image data sets that is smoothed.

9. The display according to claim 7, wherein the image generating section generates a determination signal indicating whether either the first image data set or the second image data set is generated, and the frame rate conversion section performs the frame rate conversion based on the determination signal.

10. The display according to claim 1, further comprising an image processing section performing predetermined image processing on the first image data set and the second image data set, wherein the display driving section drives the display section based on the first image data set subjected to the image processing and the second image data set subjected to the image processing.

11. The display according to claim 1, wherein each of the first image data set and the second image data set is composed of pixel data equivalent in quantity to half of the number of the pixels in the display section.

12. The display according to claim 1, wherein the first block and the second block are both composed of two pixel lines, and the first block is shifted from the second block by a single line.

13. The display according to claim 1, wherein the display section is an EL display section.

14. An image processing unit, comprising:

a display driving section driving a display section by performing a first scan with use of a first block as a driving unit in accordance with a first image data set and a second scan with use of a second block as a driving unit in accordance with a second image data set, the first block being composed of a plurality of consecutive pixel lines, the second block being composed of a plurality of consecutive pixel lines and being different from the first block, and the first image data set and the second image data set alternating with each other; and an image generating section including a frame rate conversion section that performs a frame rate conversion based on an input image signal and generating the first image data set and the second image data set based on image data subjected to the frame rate conversion, wherein the image input signal is a progressive signal.

15. A display method, comprising:

preparing a first image data set and a second image data set alternating with each other; and driving a display section by performing a first scan with use of a first block as a driving unit in accordance with the first image data set and a second scan with use of a second block as a driving unit in accordance with the second image data set, the first block being composed of a plurality of consecutive pixel lines, and the second block being composed of a plurality of consecutive pixel lines and being different from the first block; and generating an image by performing a frame rate conversion based on an input image signal and generating the first image data set and the second image data set based on image data subjected to the frame rate conversion, wherein the image input signal is a progressive signal.

* * * * *